US005949454A

United States Patent [19]

Nozawa et al.

[11] Patent Number: 5,949,454

[45] **Date of Patent: *Sep. 7, 1999**

[54] INK JET HEAD, INK JET HEAD CARTRIDGE, INK JET RECORDING APPARATUS AND METHOD FOR MAKING INK JET HEAD

[75] Inventors: Minoru Nozawa, Yokohama; Eiichiro Shimizu, Urawa, both of Japan

[73] Assignee: Canon Kabushiki Kaisha, Toyko, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/508,909

[22] Filed: Jul. 28, 1995

[30] Foreign Application Priority Data

Jul. 29, 1994 [JP] Japan ..... 6-178879
Aug. 24, 1994 [JP] Japan ..... 6-199806

[51] Int. Cl.[6] ..... B41J 2/135; B41J 2/14; B41J 2/16

[52] U.S. Cl. ..... 347/45; 347/47

[58] Field of Search ..... 347/45, 47, 65, 347/22, 33

[56] References Cited

U.S. PATENT DOCUMENTS

| | | | |
|---|---|---|---|
| 4,296,421 | 10/1981 | Hara et al. | 346/140 R |
| 4,368,476 | 1/1983 | Uehara et al. | 346/140 R |
| 4,420,764 | 12/1983 | Okada | 346/140 R |
| 4,528,576 | 7/1985 | Koumura et al. | 346/140 R |
| 4,746,935 | 5/1988 | Allen | 346/140 R |
| 4,750,009 | 6/1988 | Yoshimura | 346/140 |
| 4,890,126 | 12/1989 | Hotomi | 346/140 |
| 4,937,596 | 6/1990 | Schmid | 346/140 |
| 5,005,024 | 4/1991 | Takahashi et al. | 346/1.1 |
| 5,121,134 | 6/1992 | Albinson et al. | 346/1.1 |
| 5,136,310 | 8/1992 | Drews | 346/140 |
| 5,148,193 | 9/1992 | Inamoto et al. | 346/1.1 |
| 5,489,928 | 2/1996 | Takahashi et al. | 347/45 |
| 5,518,821 | 5/1996 | Sakaki et al. | 428/500 |
| 5,559,540 | 9/1996 | Burolla | 347/45 |
| 5,650,808 | 7/1997 | Vincent et al. | 347/43 |

FOREIGN PATENT DOCUMENTS

| | | | |
|---|---|---|---|
| 0581553 | 2/1994 | European Pat. Off. . | |
| 0595658 | 5/1994 | European Pat. Off. | B41J 2/15 |
| 0631869 | 1/1995 | European Pat. Off. . | |
| 4-211959 | 8/1992 | Japan . | |
| 6-210859 | 8/1994 | Japan . | |
| 94/08793 | 4/1994 | WIPO . | |

*Primary Examiner*—Safet Metjahic
*Assistant Examiner*—Christopher E. Mahoney
*Attorney, Agent, or Firm*—Fitzpatrick, Cella, Harper & Scinto

[57] ABSTRACT

An ink jet head for discharging a plurality kinds of inks includes a discharge port surface provided with a plurality of discharge ports for discharging ink, the discharge ports being arranged into different groups for ejecting discharging different kinds of inks. The groups of the discharge ports each for discharging different kind of ink are provided in a line, and the discharge port surface has a central water-repellent area provided with the discharge port groups and a hydrophilic belt is provided adjacent to the central water-repellent area and along an array of the discharge ports. The hydrophilic belt is separately provided for each of the groups of the discharge ports.

28 Claims, 13 Drawing Sheets

INK JET HEAD, INK JET HEAD CARTRIDGE, INK JET RECORDING APPARATUS AND METHOD FOR MAKING INK JET HEAD

BACKGROUND OF THE INVENTION

1. Field of the Invention

The present invention relates to an ink jet head adapted for use on an ink jet recording apparatus for effecting recording on a recording medium by ink discharge thereon and subjected to ink-repellent and inkphobic treatments on a face constituting ink discharge port, an ink jet head cartridge and an ink jet recording apparatus adapted for use in combination with such recording head, and a method for producing such ink jet head.

2. Related Background Art

Among various recording methods presently known, the ink jet recording method is considered extremely effective, as it is of non-impact nature almost free from noise generation, also capable of high-speed recording and of recording on plain paper without particular fixing operation.

However, in the recording operation in the ink jet recording method, because of its principle utilizing ink droplet emission, in association with a main ink droplet discharged in response to a recording signal, there may be generated a smaller ink droplet discharged from the discharge port later than said main ink droplet. Also when the main ink droplet hits the recording sheet, it may renounce at the surface thereof to generate extremely small ink droplets in the recording area.

Such small ink droplets (hereinafter also called ink mist) may be deposited on a face, including ink discharge ports, of the ink jet head, often forming an ink pool. Formation of such ink pool is known to induce certain troubles, such as unstable ink droplet discharge from the discharge ports and ink discharge failure.

For avoiding such drawbacks, the head face including the ink discharge ports has conventionally been subjected water-repellent treatment. FIG. 1 schematically shows a conventional ink jet head of which the discharge port surface or face is subjected to such water-repellent treatment.

In FIG. 1 there are shown a water-repellent film 101; an ink supply aperture 110; a grooved top plate 105 in which an ink chamber, ink flow paths and a discharge port face are integrally molded; ink discharge ports 104; a discharge ports face 100 including said ink discharge ports; and an element board 107 bearing elements for causing ink discharge from the discharge ports. The above-mentioned water-repellent film 101 is formed on the substantially entire surface of the discharge port face 100.

Formation of such water-repellent film 101 on the substantially entire surface of the discharge port face 100 reduces the ink deposition around the ink discharge ports, thereby somewhat alleviating the aforementioned drawbacks such as the unstable ink discharge.

However, in case of a recording operation for a prolonged period in continuous manner with a high frequency drive and with a high printing speed, or a recording operation with a high duty, a larger amount of ink mist is generated whereby the ink droplets are gradually deposited on the discharge port face to eventually form a large ink drop. Such large deposited ink drop may affect the ink discharging operation.

In order to resolve the above-mentioned drawback encountered in the recording head of which the discharge port face is substantially entirely made water-repellent, there is already proposed, as a background art, a recording head which is provided with a central water-repellent area surrounding an area including plural ink discharge ports, and a hydrophilic area formed along the direction of array of said plural ink discharge ports in at least one of the areas adjacent to said central water-repellent area and spaced by a predetermined distance from said plural ink discharge ports.

FIG. 2 illustrates the discharge port face of such recording head provided with the water-repellent area and the hydrophilic areas mentioned above.

As shown in FIG. 2, a water-repellent area 101 is formed around ink discharge ports 105, and stripe-shaped hydrophilic areas 102 are provided at distances $H_1$, $H_2$ from the discharge ports, in parallel manner to the direction of array thereof. Outside the stripe-shaped hydrophilic areas 102, there are provided island-shaped hydrophilic areas 103.

Such configuration allows to prevent the movement of the ink droplets, deposited on the discharge port face 100 and grown thereon, toward the discharge ports.

On the other hand, in the field of ink jet recording becoming popular is color recording by discharging inks of plural colors.

As a compact recording head for such color recording, the present inventors have developed a recording head in which groups of discharge ports for respectively different ink colors are arranged in a linear array. FIG. 3 illustrates the discharge port face of such recording head prepared by the present inventors for trial purpose. In the illustrated recording head, the discharge port face 100 has first to fourth discharge port groups from left to right, for inks or respectively different colors. Outside these discharge port groups there are provided stripe-shaped hydrophilic areas 102 as explained above, and, further outside there are provided island-shaped hydrophilic areas (not illustrated).

Such recording head, however, has been found to be associated with the following drawbacks in the color recording.

In such integral color recording head utilizing plural inks, the inks may be mixed in complex manner and may mutually react on the discharge port face, eventually forming solid deposits and precipitates and smearing the discharge port face.

Also the inks mixed on the discharge port face may be pushed into the ink discharge ports at the head wiping operation with a blade at the head recovery, thus resulting in undesirable color mixing on the printed sheet. If preliminary discharge is conducted prior to the recording operation in order to prevent such color mixing, there is required a considerably large amount of preliminary discharge, thus leading to ink waste.

Furthermore, in case of using ink of low surface tension, capable of easily wetting the discharge port face, the ink in the hydrophilic areas and the discharged ink are mutually linked by the ink mist or by the ink left in the wiping operation, thus eventually forming a large wet area and inducing a failure in the ink discharge.

Furthermore, in an ink jet head for color recording, in which the ink discharge amounts or other conditions are made different for respective colors in order to obtain an optimum image, the state of the ink mist deposited around the ink discharge ports varies depending on the dimension of the ink discharge ports, the ink discharge amount and ink specy. Thus it may become difficult to achieve stable ink discharge if the hydrophilic area is formed in a same shape on the discharge port face, disregarding these differences.

SUMMARY OF THE INVENTION

In consideration of the foregoing, an object of the present invention is to provide an integral color-recording ink jet head capable of achieving satisfactory color recording for a prolonged period in continuous manner, and an ink jet head cartridge and an ink jet recording apparatus adapted for use in combination with such ink jet head, and a method for producing the same.

Another object of the present invention is to provide an ink jet head capable of achieving stable ink discharge without color mixing, even in the presence of variation in the dimension of the ink discharge ports, in ink and/or in the ink discharge amount, and an ink jet head cartridge and an ink jet recording apparatus adapted for use in combination with such ink jet head.

The above-mentioned objects can be attained, according to the present invention, by an ink jet head comprising a discharge port face in which plural discharge port groups for discharging respectively different inks, each of said groups being composed of plural ink discharge ports, arranged in a linear array, and on which provided are a central water-repellent area containing said plural discharge port groups and stripe-shaped hydrophilic areas arranged adjacent to said central water-repellent area and along said array of the discharge ports and provided respectively corresponding to said discharge port groups.

Also the ink jet head cartridge of the present invention is principally composed of the above-mentioned ink jet head and ink containers for containing inks to be supplied to said ink jet head.

Also the ink jet recording apparatus of the present invention is principally composed of the above-mentioned ink jet head, and drive signal supply means for supplying a drive signal for driving said ink jet head.

Also the method for making the ink jet head of the present invention comprises a step for applying water-repellent treatment to a discharge port face on which plural discharge port groups for discharging respectively different inks, each of said groups being composed of plural ink discharge ports, arranged in a linear array, and a step of forming stripe-shaped hydrophilic areas respectively for said discharge port groups, in positions separate from said array of the discharge ports and along the direction of said array.

The present invention can minimize the complex mixing of inks on the discharge port face, by forming, on the discharge port face, a central water-repellent area surrounding an area containing said plural discharge port groups, and hydrophilic areas which are separated respectively for said discharge port groups and which are provided in at least one of the sides adjacent to said central water-repellent area and separated by a predetermined distance from said plural discharge ports, along the direction of array of said discharge port groups.

DETAILED DESCRIPTION OF THE PREFERRED EMBODIMENTS

Now the present invention will be clarified in detail by preferred embodiments shown in the attached drawings.

Embodiment 1

Figure 4:
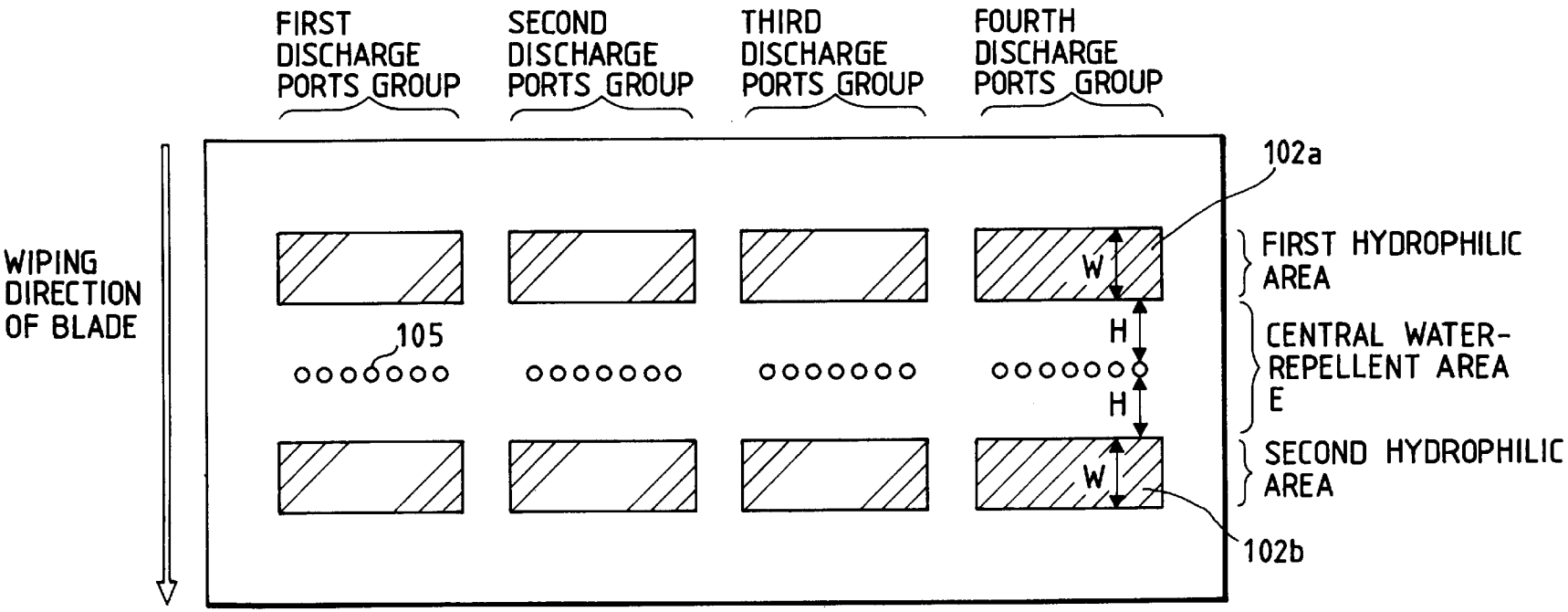
FIG. 4 is a view of an ink jet head of the present invention, seen from the side of the discharge port face thereof.

Now referring to FIG. 4, in the substantially central area of the discharge port face, a plurality of discharge ports 105 of a diameter of ca. 30 $\mu$m are linearly arranged with a given pitch so as to constitute first to fourth discharge port groups. Around said discharge ports there is formed a central water-repellent area E subjected to water-repellent treatment. Adjacent to the central water-repellent area E, along the array of the discharge ports and with a predetermined distance H therefrom, first and second stripe-shaped hydrophilic areas 102*a*, 102*b* are formed on both sides, in divided manner respectively corresponding to the discharge port groups and over a width W.

The above-mentioned first and second hydrophilic areas 102*a*, 102*b* are separated from the discharge ports by a distance H of about 35 to 250 $\mu$m and have a width W of 100 to 800 $\mu$m. Said first and second hydrophilic areas 102*a*, 102*b* are constructed as stripe-shaped grooves and serve to trap the ink moving from the outside of the discharge port face, thereby preventing the ink from reaching the discharge ports. In this embodiment, the belt-like hydrophilic portion is longer than the discharge port group so that ink can be prevented from entering other discharge port groups.

These groove-shaped hydrophilic areas are formed by applying water-repellent treatment to the surface of a resinous substrate constituting the discharge port face to form a water-repellent film thereon and then applying laser working. Laser irradiation from the side of the water-repellent film scrapes off the surface of the discharge port face, thereby eliminating a part of the water-repellent film and forming the hydrophilic area.

Figure 5:
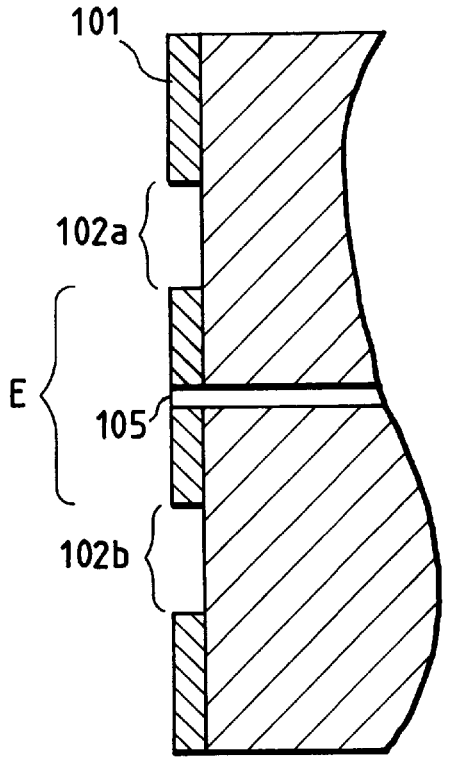
FIG. 5 is a partial cross-sectional view of an ink jet head of the present invention, in the vicinity of ink discharge ports.

Therefore, in the cross section of thus worked groove-shaped hydrophilic area, as in the hydrophilic areas 102*a*, 102*b* schematically shown in FIG. 5, the surface of the resinous substrate is exposed to constitute the hydrophilic area in the bottom portion and a part if the groove walls rising from said bottom, and the remaining groove walls are constituted by the water-repellent film 101.

The ink droplet captured in thus formed groove-shaped hydrophilic area adheres well to the groove bottom and a part of the groove walls, and it is therefore well prevented from travelling on the discharge port face. It can however be easily removed by the cleaning operation of the discharge port face to be explained later. The groove formed on the discharge port face preferably has a depth of 0.2 to 0.6 μm in case the thickness of the water-repellent film is 0.1 to 0.2 μm.

The first and second hydrophilic areas 102*a*, 102*b* can be formed as stripes as explained above, but they may also be shaped as suitably divided stripes or substantially as spot-shaped islands, as long as they can trap minute ink mist to maintain the effect of the water-repellent area around the ink discharge ports.

The present invention includes not only the configuration in FIG. 4 having the first and second groove-shaped hydrophilic areas 102*a*, 102*b* on both sides of the discharge ports, but also a configuration having treated area, such as the first groove-shaped hydrophilic area 102*a* only on one side of the discharge ports.

The present invention is particularly effective under a recording condition where the ink mist generation increases with an integral color recording head, such as high-frequency recording, high duty recording or high-speed recording.

Embodiment 2

Specific patterns of the water-repellent areas and the hydrophilic areas on the discharge port face of the present invention will be explained in the following embodiments, with reference to FIGS. 6 and 7.

The discharge port face of the ink jet head is subjected, on the entire area thereof, to water-repellent treatment and hydrophilic areas of the following patterns are formed thereon.

Figure 6:
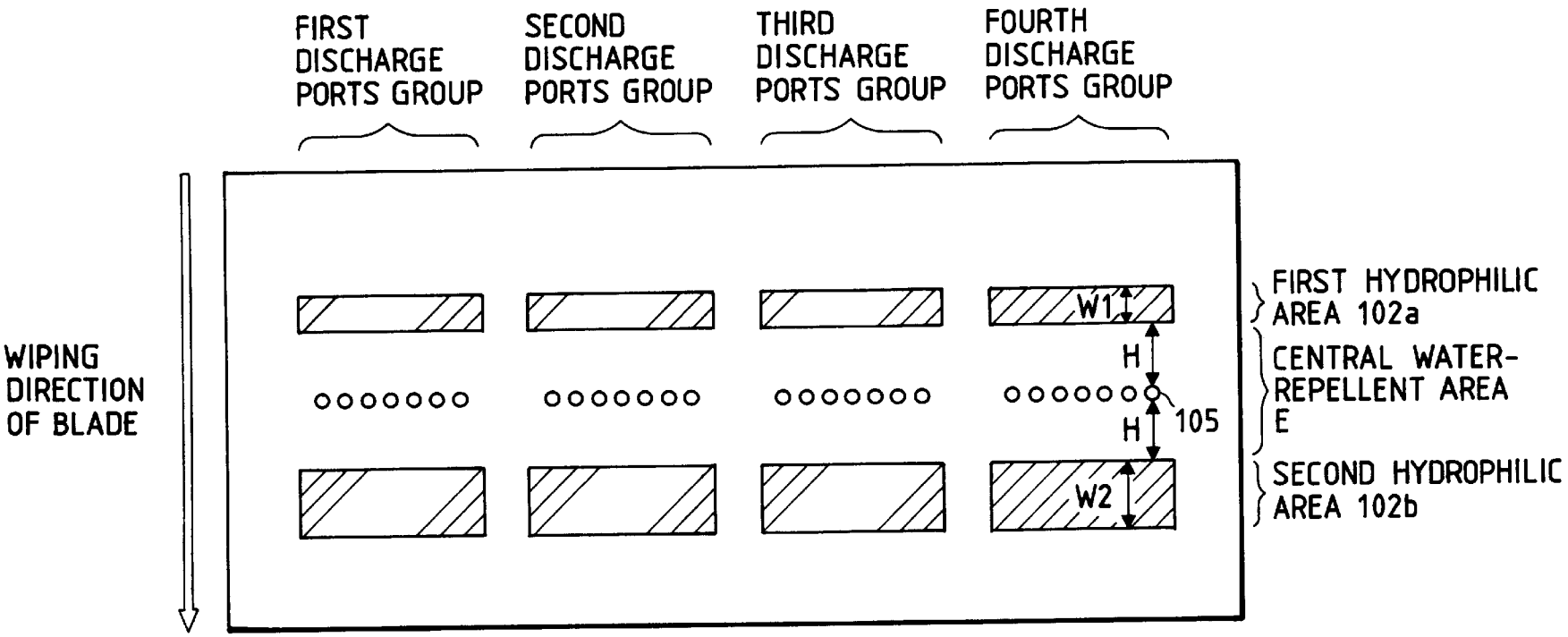
FIGS. 6 and 7 are views of ink jet heads of the present invention, seen from the side of the discharge port face thereof.

In the pattern of the hydrophilic areas shown in FIG. 6, the width W1 of the pattern 102*a* at the starting (up-stream) side of the blade wiping is made smaller than that W2 of the pattern 102*b* at the other side.

More specifically, satisfactory results can be obtained in wiping with the blade and in trapping the ink pool generated from condensation of ink mist when W1 is selected about 100 to 400 μm and W2 is selected about 400 to 800 μm.

Embodiment 3

Figure 7:
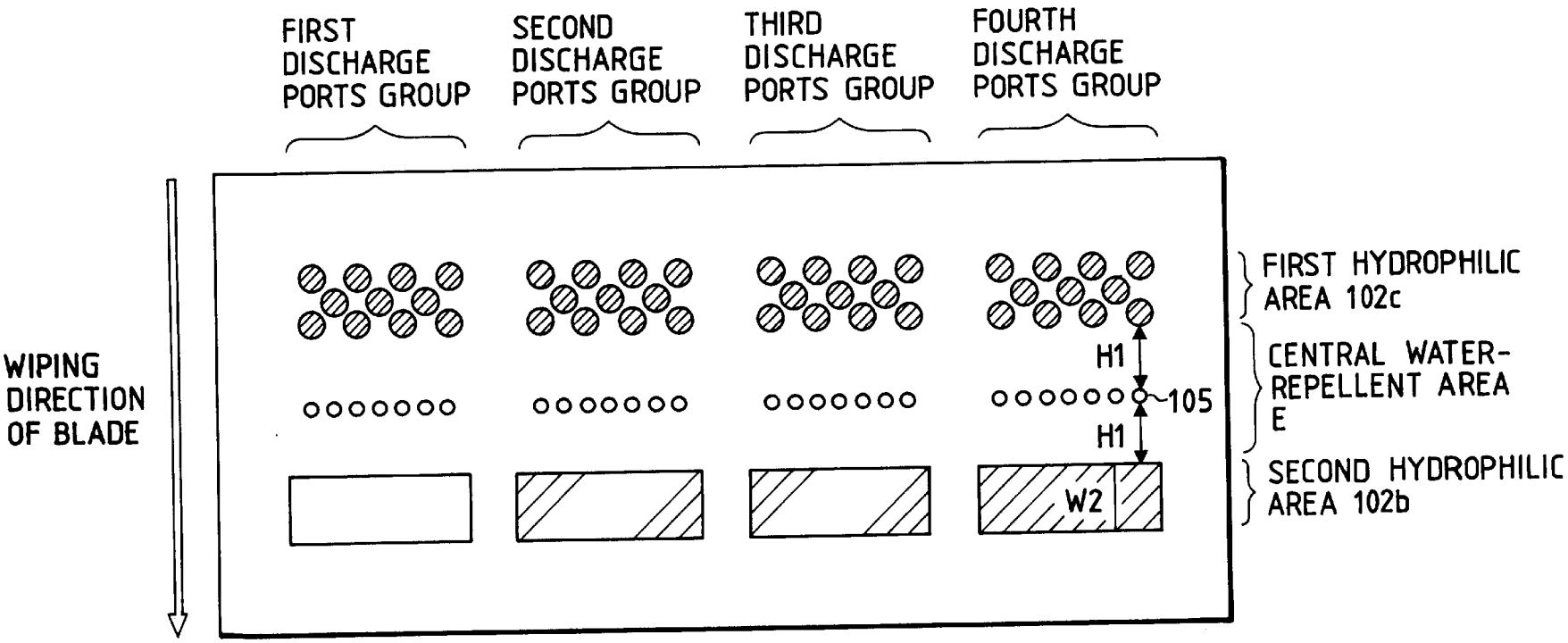

FIG. 7 shows a pattern consisting of small island-shaped hydrophilic areas. Such configuration provides a similar effect by selecting the total area S102*c* of the above-mentioned island-shaped areas 102*c* in each discharge port group smaller than the area S102*b* of the stripe-shaped pattern 102*b*.

Figure 8:
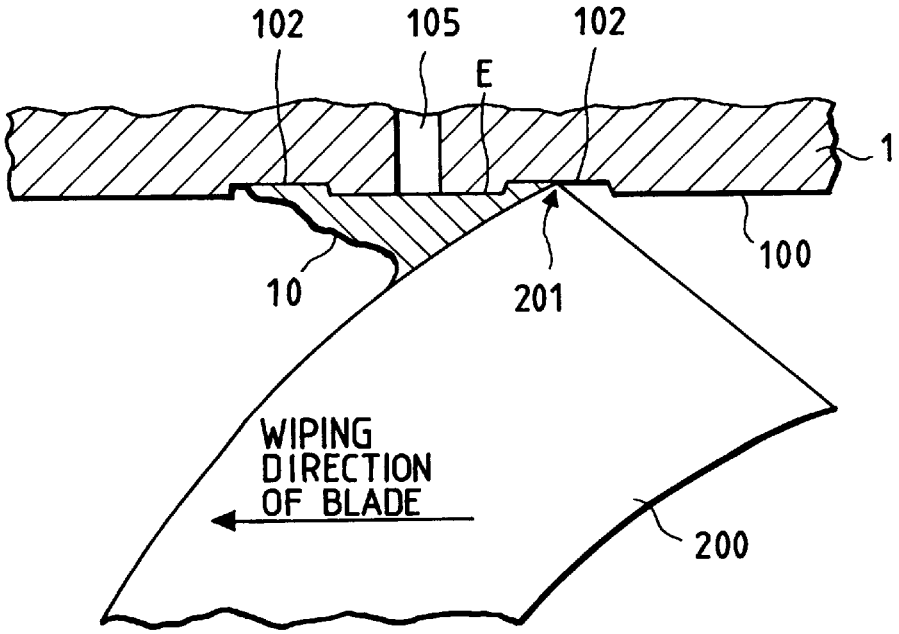
FIG. 8 is a view showing a wiping operation with a cleaning blade.

FIG. 8 is a schematic cross-sectional view showing a cleaning state of the discharge port face 100 with a cleaning blade 200, which is to remove the ink mist and ink droplets present on groove-shaped hydrophilic areas 102 on the discharge port face 100 and on a central water-repellent area E around the discharge ports 105, by a relative sliding movement in a direction indicated by an arrow on the discharge port face 100.

The cleaning blade 200 effects a relative sliding movement, in a direction indicated by an arrow, on the discharge port face 100 by a scanning motion of the ink jet head, wherein the ink droplets trapped in the groove-shaped hydrophilic areas 102 are scraped off by an edge 201 and are eliminated from the grooves. The eliminated ink drop grows in the movement, collecting the ink mist present in the central water-repellent area E.

Thus the ink drops present on the discharge port face 100 can be satisfactorily wiped off, by collection thereof in succession in the course of movement on said face 100 by the cleaning blade 200.

As the wiped ink moves in the form of a very large liquid block on the discharge port face 100, the ink carried by the blade intrudes the discharge ports by a negative pressure in the ink tank (not shown) when said ink liquid block passes on the discharge ports, but the configuration of the present invention, for separating the inks for respectively discharge port groups on the discharge port face and carrying the different inks individually as far as possible by the blade, minimizes the color mixing resulting from such ink intrusion and enables easy removal of the intruding ink by the preliminary discharge.

Also leftover in the wiping operation of the blade can be reduced by selecting, as explained in the foregoing embodiments, the hydrophilic area at the starting side of the wiping operation of the blade larger than the hydrophilic area on the other side of the central water-repellent area.

In the foregoing embodiments, the hydrophilic areas and the water-repellent areas are constructed same for the different inks, but, for achieving even better ink discharge, it is desirable to vary the shape and the arrangement of the hydrophilic areas and the water-repellent areas according to the properties of the inks such as color and viscosity thereof, and the discharge amounts of the inks. Such configuration will be explained in the following embodiment.

Embodiment 4

Figure 9:
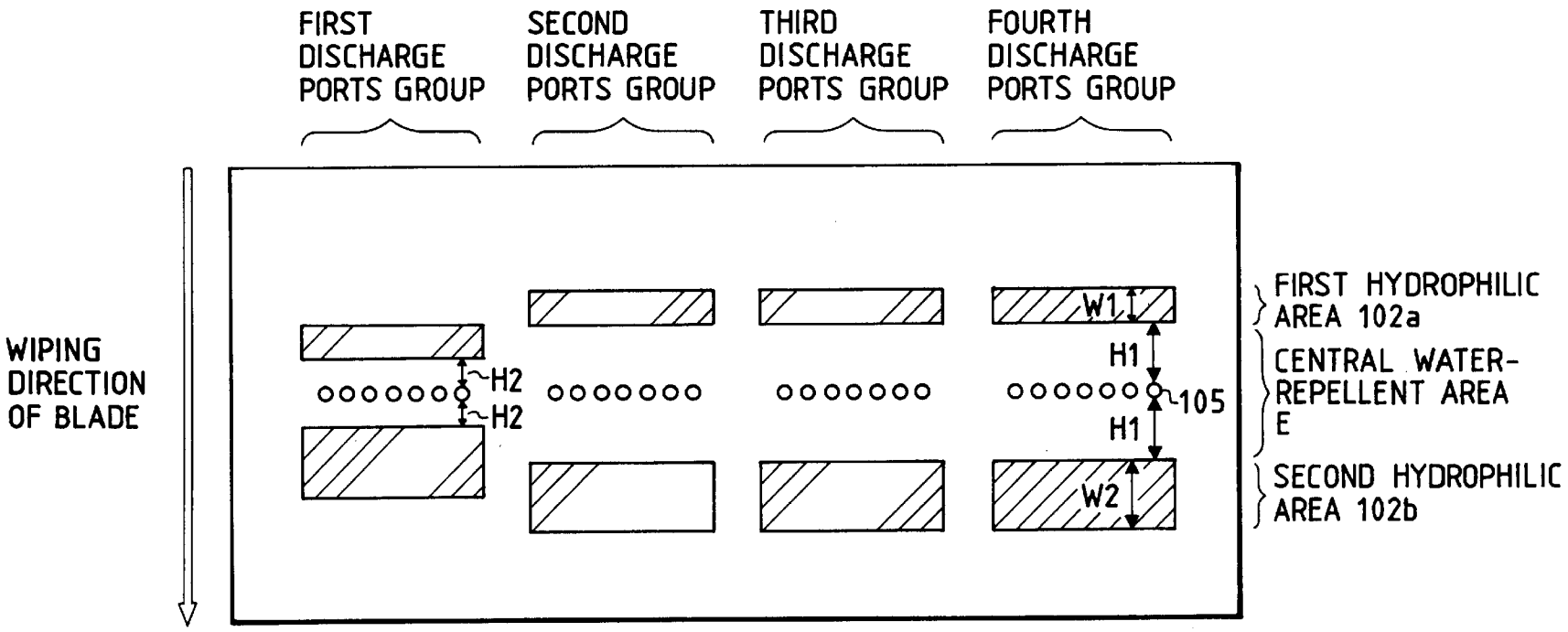
FIGS. 9 and 10 are views of ink jet heads of the present invention, seen from the side of the discharge port face thereof.

The pattern of the hydrophilic areas shown in FIG. 9 is effective in case of using inks different in the surface tension and in the wettability on the discharge port face. For example black ink is used in the first nozzle group, and inks of cyan, magenta and yellow colors are used in the second to fourth nozzle groups.

As the black ink gives emphasis on the quality of characters, it is often designed with reduced permeability into the paper thereby increasing the density of dye remaining on the paper surface. On the other hand, color inks are given good permeability as they have a high deposition density 9300% max.

Thus, the black ink and the color inks are different in surface tension, as the emphasized properties are different as explained above. As a result, the color ink has larger wettability on the discharge port face, thus being apt to induce ink discharge failure, caused by the linkage of the ink between the discharge port and the hydrophilic area. This drawback can be resolved by selecting a condition H2<H1 in the distances from the discharge ports to the hydrophilic areas.

As explained in the present embodiment, it is rendered possible to prevent formation of linkage of the ink in the hydrophilic area and the ink to be discharged by the ink mist or ink left in the wiping operation with the blade, by differentiating the distance from the discharge ports to the hydrophilic area according to the wettability of the used ink on the discharge port face, more specifically decreasing said distance for ink of a higher surface tension and a poorer wettability on the discharge port face and increasing said distance for ink of a lower surface tension and a better wettability.

Embodiment 5

Figure 10:
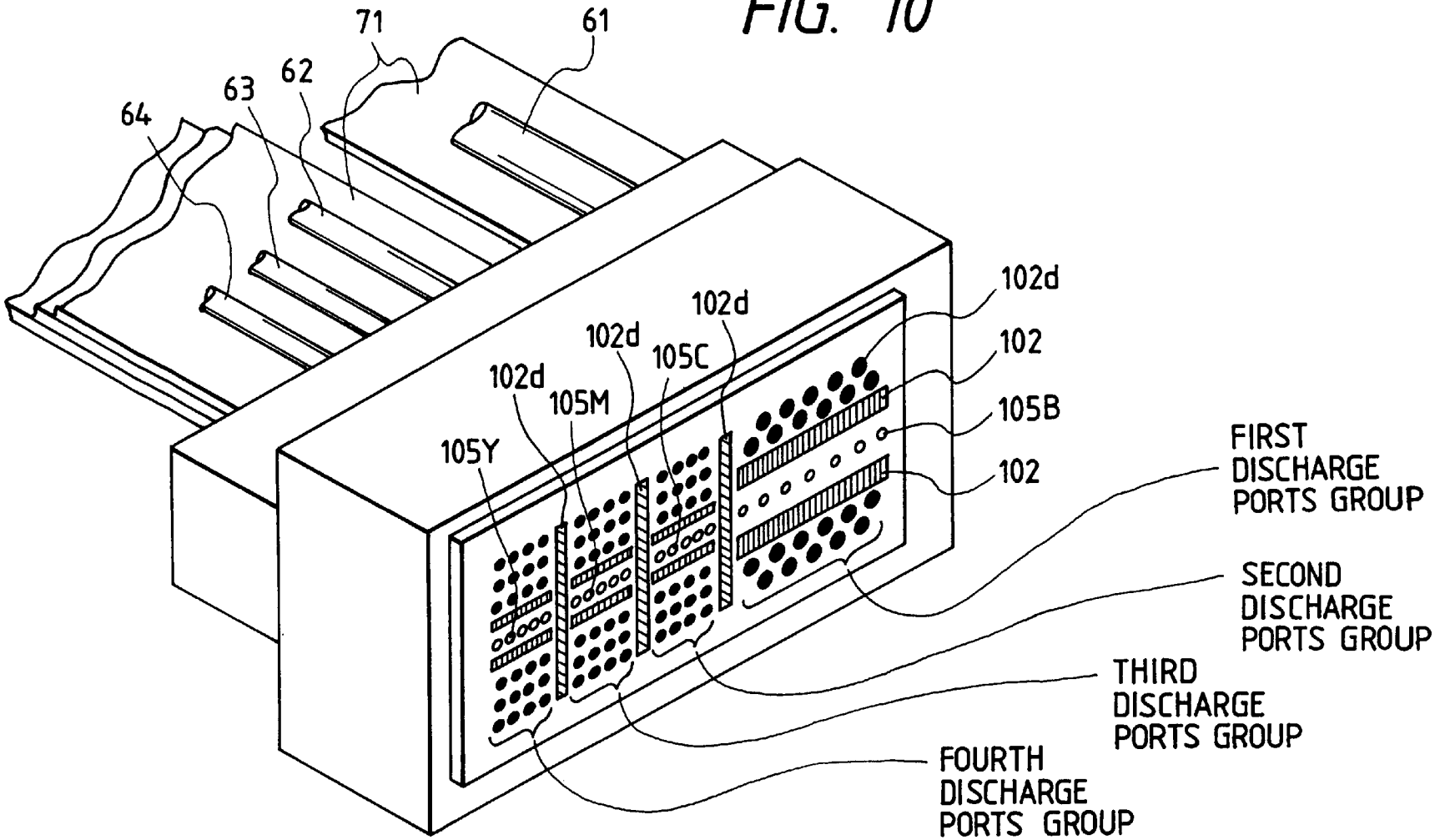

FIG. 10 illustrates the entire ink jet head of the present embodiment, wherein shown are a first group 105B of discharge ports for black ink; discharge port groups 105C, 105M, 105Y respectively for cyan, magenta and yellow inks; ink supply tubes 61–64 for supplying the discharge ports with respective inks; and a flexible cable 71 connected to an unrepresented main body for supply of print signals to the recording head.

Figure 1:
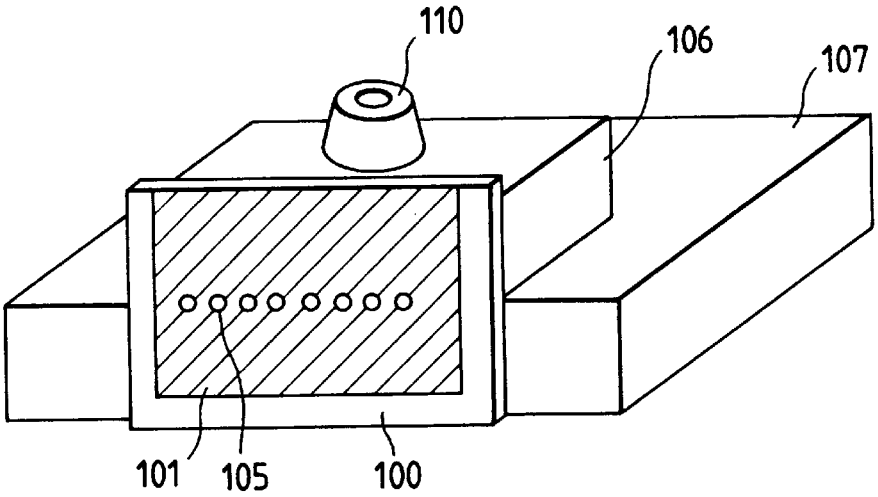
FIG. 1 PRIOR ART
FIG. 1 is a view of a conventional ink jet head, seen from the side of a discharge port face thereof.
Figure 2:
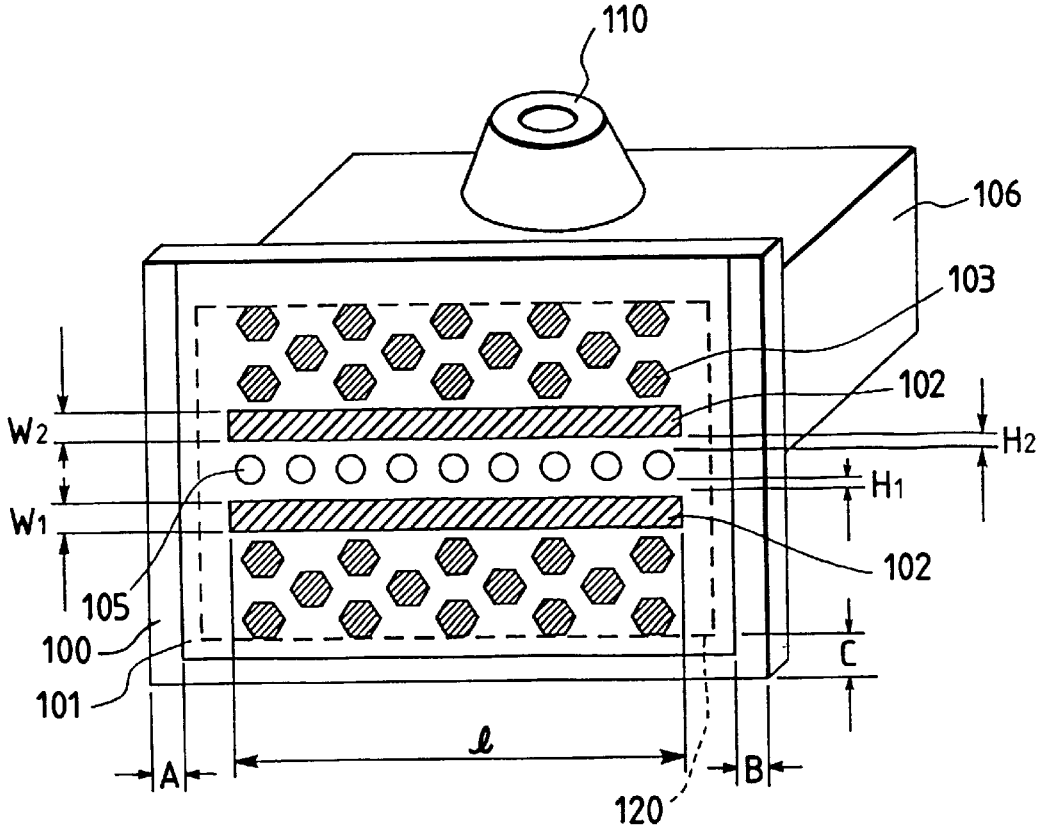
FIG. 2 PRIOR ART
FIGS. 2 and 3 are views of ink jet heads of the background art, seen from the side of the discharge port face thereof.
Figure 3:
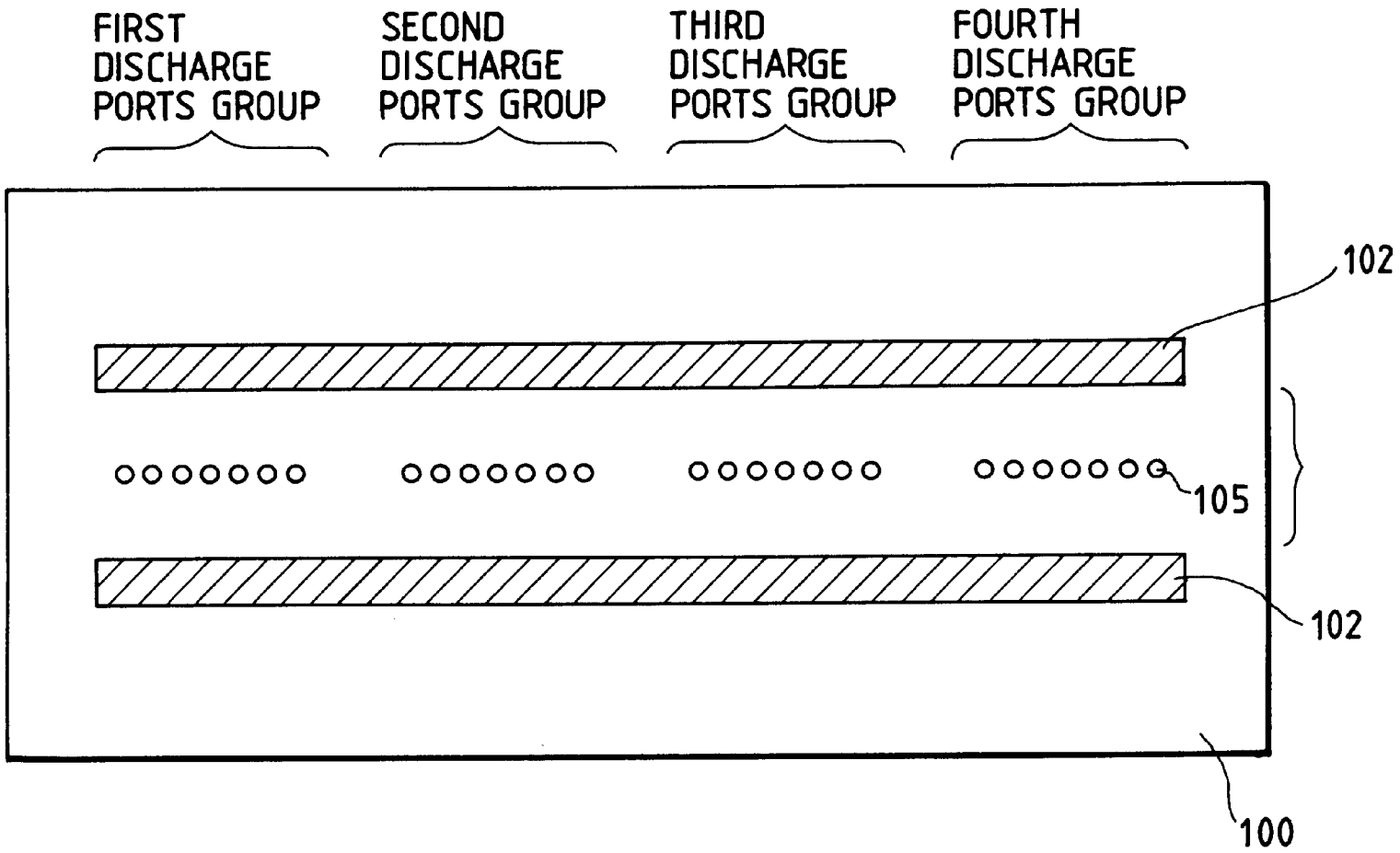

In the present embodiment, the black ink discharge ports 105B are formed larger than other ink discharge ports 105C, 105M, 105Y for providing a larger ink discharge amount. On the discharge port face there are provided stripe-shaped hydrophilic areas and island-shaped outer hydrophilic areas 102*d* as in the foregoing embodiments, and these hydrophilic areas are optimized in arrangement according to the ink discharge amount in respective group. More specifically, the arrangement of the hydrophilic areas etc. of the present embodiment can be described, with the symbols employed in the description of the background art in FIG. 2, as follows.

In the present embodiment, for the black ink, the discharge ports 105B have a diameter of 35 $\mu$m; W1 and W2 are 0.8 mm; H1 and H2 are 0.94 mm; and, in the island-shaped hydrophilic areas, each hexagon has an area of 0.15 $mm^2$ and the hydrophilic area occupies a ratio of 40%.

For the cyan, magenta and yellow inks, the discharge ports have a diameter of 27 $\mu$m; W1 is 0.435 mm; W2 is 0.37 mm; H1 is 0.04 mm; H2 is 0.105 mm; and, in the island-shaped hydrophilic area, each island has an area of 0.08 $mm^2$ and the hydrophilic area occupies a ratio of ca. 40%.

In addition partitions 102*d* between the colors are formed to further effectively present the mixing of different colors in an integral recording head in which the ink discharge ports for different colors are integrally formed on a substrate. The above-mentioned partitions 102*d* are formed by an excimer laser simultaneously with and similarly to other hydrophilic areas. However such partitions 102*d* between different colors need not be formed by the excimer laser but may be composed also by protruding or recessed structures formed at the molding of the grooved top plate, so as to limit the ink movement between different colors.

In the foregoing embodiment, the configuration of the water-repellent area and the hydrophilic areas on the discharge port face is varied, in each group of the discharge ports, according to the ink discharge amount, size thereof and ink used therein.

In the following there will be explained a preferred configuration of the water-repellent area and the hydrophilic areas for each of the parameters mentioned above.

In case the ink discharge amount is different between the groups of discharge ports, the hydrophilic are corresponding to the discharge port group of the larger ink discharge amount is preferably made larger.

In case the diameter of the discharge ports is different between the groups of discharge ports, the distance from the centers of the discharge ports to the hydrophilic area is preferably made larger for the discharge port group of the larger diameter.

Also in case the specy of ink is different between the groups of discharge ports, the distance from the edges of the discharge ports to the hydrophilic area is preferably made larger for the discharge port group corresponding to ink of a higher wettability (ink showing a smaller contact angle with a water-repellent surface).

These considerations allow to prevent the influence on the ink discharge in case the ink drops are deposited on the discharge port face.

Embodiment 6

In the following there will be explained a configuration of the ink jet head in which the discharge port face of the foregoing embodiments is applicable.

Figure 11:
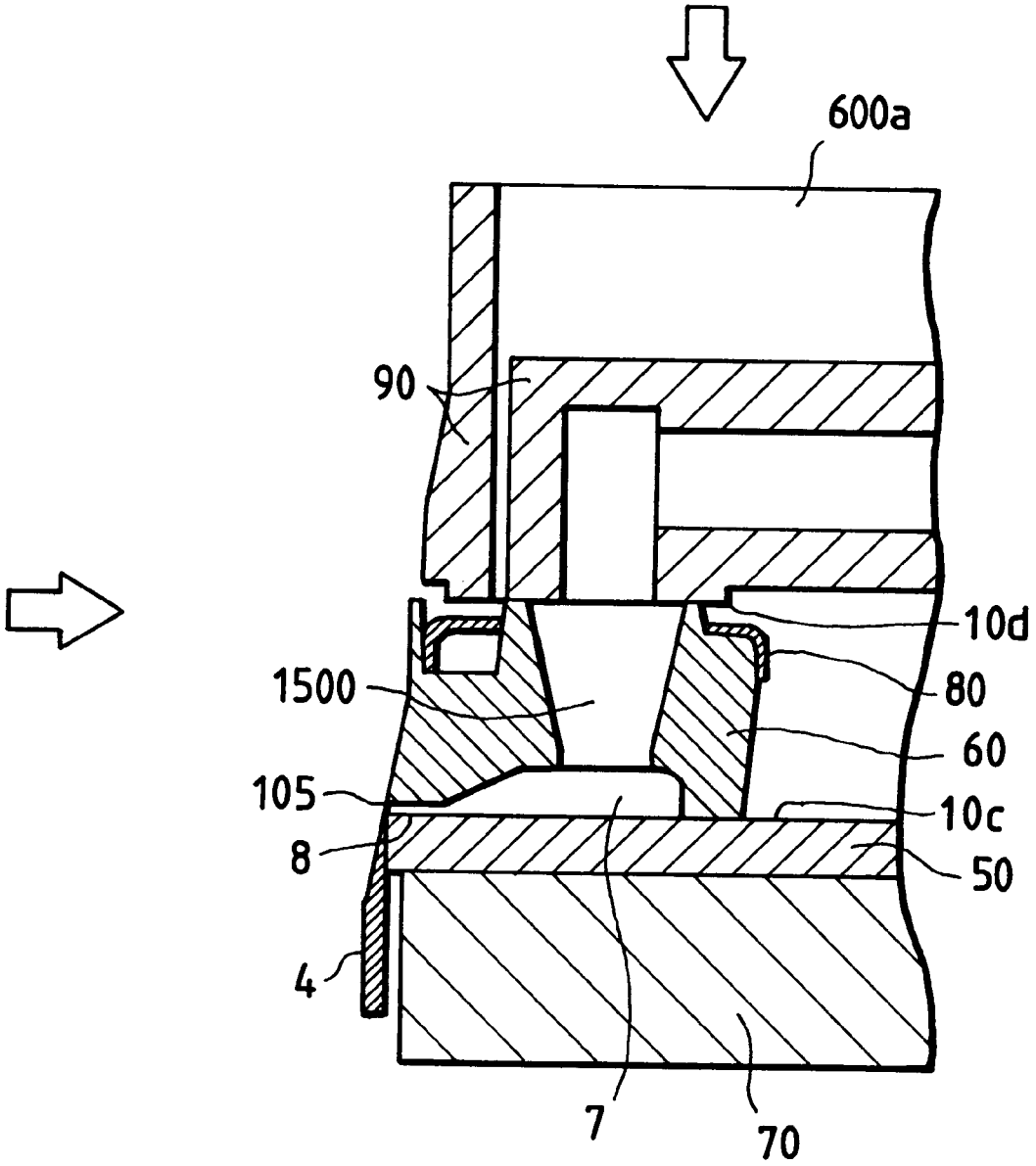
FIG. 11 is a cross-sectional view of an ink jet head of the present invention.

FIG. 11 is a cross-sectional view of an ink jet head of the present invention.

The ink jet head is composed of an element board 50 (hereinafter called heater board) bearing thereon a heat generating element for generating an ink discharge pressure, and a grooved member 60 provided with a surface structure (grooves) for constituting an ink chamber 7 for containing ink (recording liquid) and an ink flow path 8, when adhered to said element board 50. Said grooved member 60 (hereinafter called grooved top plate) is integrally provided with a discharge port plate 4 containing therein an ink discharge port 105 adapted to discharge the ink and communicating with the ink flow path 8. In the present embodiment, as explained in the foregoing embodiments, there are provided groups of discharge ports respectively corresponding to black, cyan, magenta and yellow colors, and there are provided four groups of ink flow paths and ink chambers corresponding thereto.

The heater board 50 is fixed, with adhesive material, to a supporting board 70, and the grooved member 60 is temporarily adhered in such a manner that heaters 80 respectively coincide with the ink flow paths 8 on the grooved member 60 and is fixed by a mechanical biasing force of a pressure spring 80. The orifice plate 4 is provided perpendicularly at the front end of the supporting board 70.

Ink is supplied, from an ink supply member 90, through an ink supply aperture provided in the upper part of the grooved member 60. The ink supply member 90 is provided with an unrepresented protruding rod and is fixed to the supporting board 70 by inserting said protruding rod into a hole formed on the supporting board 70, followed by thermal caulking.

Embodiment 7

Figure 12:
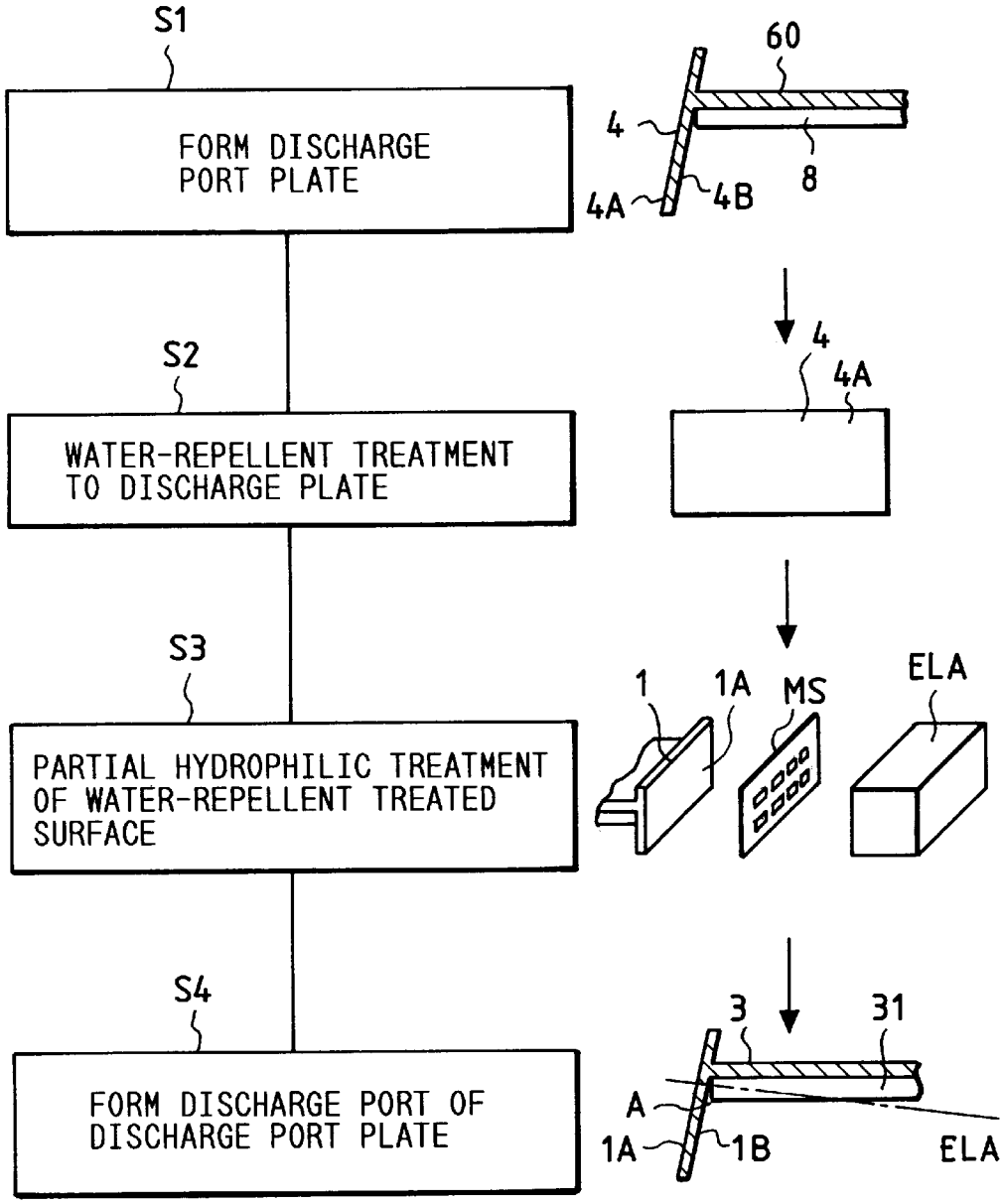
FIG. 12 is a view showing a method for producing the ink jet head of the present invention.

In the foregoing there has been explained an ink jet head provided with a discharge port face containing water-repellent areas and hydrophilic areas. In the following there will be explained, with reference to FIG. 12, a process for producing such ink jet head.

At first there is prepared, by injection molding, a grooved top plate 60 integrally provided with common liquid chambers (not shown), liquid flow paths 8 and an orifice plate 4 (step S1).

4A and 4B respectively indicate the front and rear faces of the orifice plate 4 containing the ink discharge ports. On the front face 4A of the orifice plate there are provided a first discharge port group with 64 discharge ports, and second to fourth groups with 24 discharge ports each, with a pitch of 360 dpi.

On thus molded grooved top plate 60, the front face of the orifice plate 4 is subjected to water-repellent treatment (step S2).

The water-repellent agent is applied, in the present embodiment, not on the entire surface of the front face of the orifice plate but on a certain area thereof including a capping area, in order to prevent migration of the water-repellent agent to the rear face at the application and drying thereof.

Figure 13:
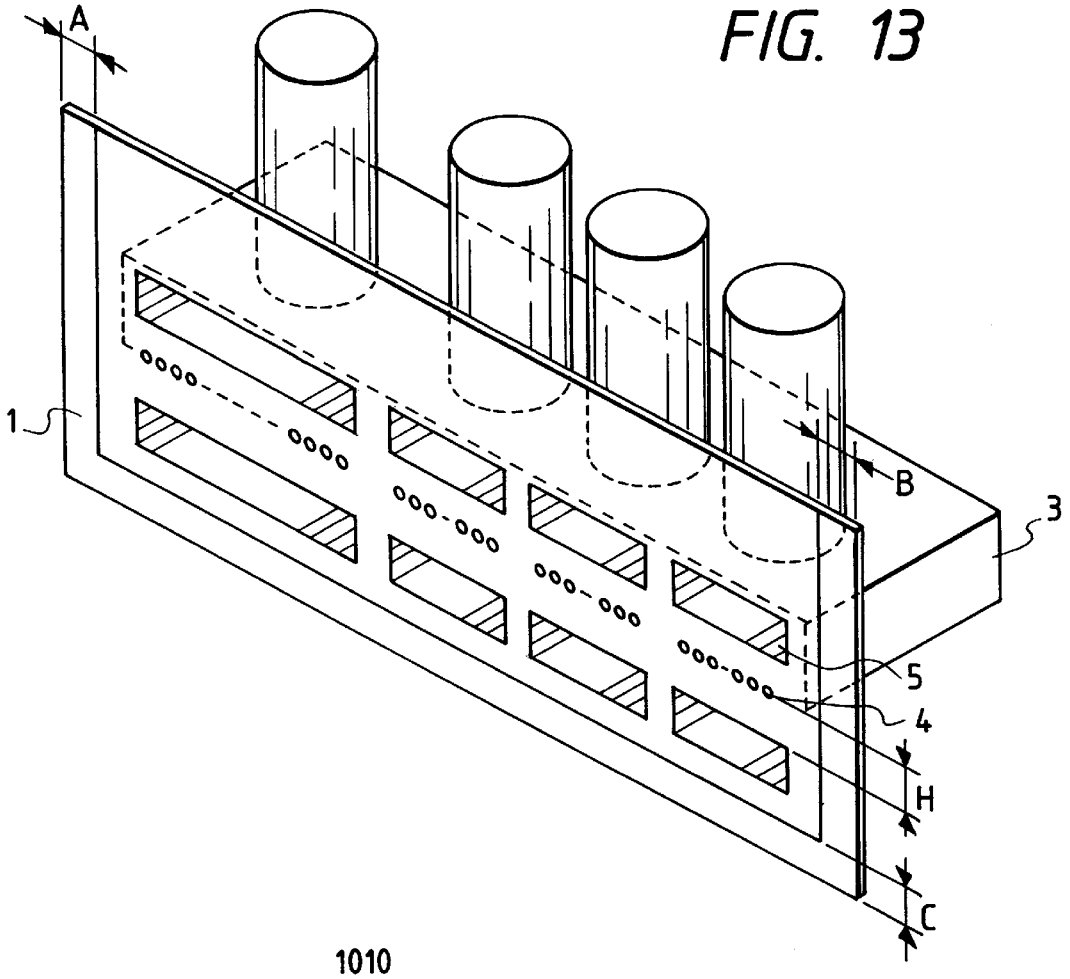
FIG. 13 is a view showing a cap fitting position.

For example, if the capping areas A, B, C are limited to 0.6 mm from the edges of the discharge port face as shown in FIG. 13, the water-repellent agent is applied to a position of 0.5 mm from the edges in the areas A, B, C.

However, if the water-repellent agent does not migrate to the rear face of the plate, it may be applied to the entire surface of the discharge port face.

The water-repellent treatment is achieved by transfer coating, with a coating thickness of 0.1–0.2 $\mu$m.

However such treatment is not limited to such transfer coating but may also be achieved by an ordinary coating method such as roller coating.

Also the coating thickness of the water-repellent agent is not limited to the range mentioned above, but a smaller thickness tends to result in an insufficient water-repellent effect while, in case of an excessively large thickness, the water-repellent film becomes easily peelable for example by the cleaning operation.

The grooved top plate 3 with the orifice plate subjected to the water-repellent treatment is then subjected to a heat treatment, thereby thermally curing the water-repellent agent to complete the water-repellent film.

Then the water-repellent film formed on the surface 1A of the orifice plate 1 is irradiated with the light of an excimer laser ELA through a mask MS having apertures corresponding to the hydrophilic areas to be formed, whereby the hydrophilic areas formed by the elimination of the water-repellent agent and a part of the surface of the orifice plate (step S3).

The power of the excimer laser in this operation is selected as 200 mj/cm$^2$, one to several pulses, for a thickness of the water-repellent agent of 0.1 to 0.2 $\mu$m.

Subsequently the discharge ports 4 are formed by irradiation of the rear face 1B of the orifice plate 1 by the excimer laser, with an incident angle range of 5° to 10° (step S4).

In this laser irradiating operation, carbon is deposited on the front face of the orifice plate, but such carbon can be removed by applying and then peeling an adhesive tape.

The ink jet head can be completed by adhering thus formed grooved top plate 3 and the board bearing heat-generating resistors for causing ink discharge.

The material constituting the grooved top plate 60 has often to be selected from limited materials in consideration of the molding property and the ink contact property, and polysulfone is employed in the present invention. Polysulfone shows affinity to the ink, with a contact angle of about 60° to the ink.

The water-repellent agent can be a polymer with fluorine-containing heterocyclic structure in the main chain such as Sitop CTX-105 or CTX-605 (manufactured by Asahi Glass Co.); a fluoroolefin-vinyl ether alternate copolymer such as Lumiflon (Asahi Glass Co.), Fluonate (DIC), Ceflalcote (Central Glass Co.), C-1 (Daikin Co.), Triflon (Mitsui Petrochemical Co.), Kynar-SL or Kynar-ADS (Atochem Corp.); a photo-radical-polymerizable fluorinated resin composition composed of a reactive oligomer and a diluting monomer, such as Defensa (DIC); a copolymerized comb-shaped fluorinated polymer such as LF-40 Soken Kagaku Co.); a fluorosilicone such as KP801M (Shinetsu Chemical Co.); or a perfluorocyclopolymer such as Teflon-AF (DuPont de Nemeur).

Among these materials, particularly advantageous is Sitop CTX-105, which has a contact angle of ca. 70° to the ink.

In the present invention, satisfactory effect against the ink mist can be achieved by selecting the ink-repellent agent in such a manner that the ink contact angle is different by about 10° or more between the water-repellent area and the hydrophilic area.

The groove-shaped hydrophilic area 5 is formed substantially parallel to the direction of array of the discharge ports, with a predetermined distance H from said discharge ports.

The ink jet head, treated as explained above on the discharge port face, can achieve satisfactory recording when supplied with the recording signals on an apparatus explained in the following.

Embodiment 8

Figure 14:
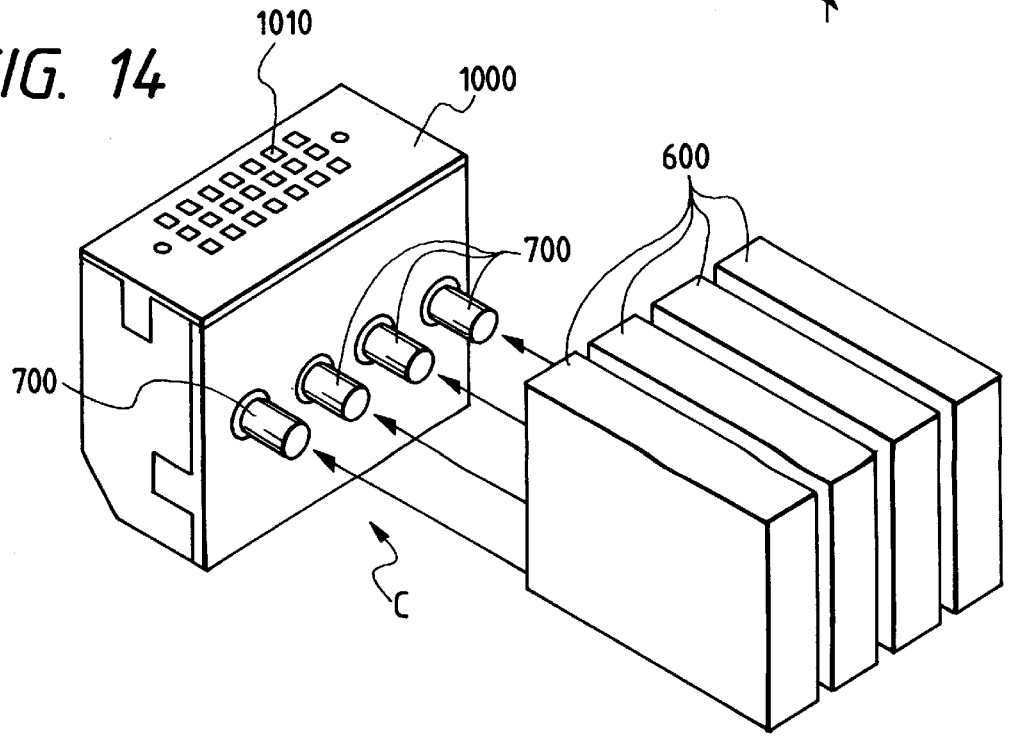
FIG. 14 is a view showing an ink jet cartridge of the present invention.

FIG. 14 is a perspective view of an ink jet cartridge in which an ink jet head of the present invention is detachably connected to ink tanks of respective colors.

FIG. 14 is seen from the side of a contact pad 1000 for receiving electrical signals from the main apparatus. In FIG. 14, the discharge port face is positioned in a direction C. Ink tanks 600 of respective ink colors are connected to the recording head, by individually inserting ink supply tubes 700 of the ink jet head into respective joint apertures (not shown) of the ink tanks. Also the ink tanks 600 of the respective colors can be individually detached from the ink jet head.

Figure 15:
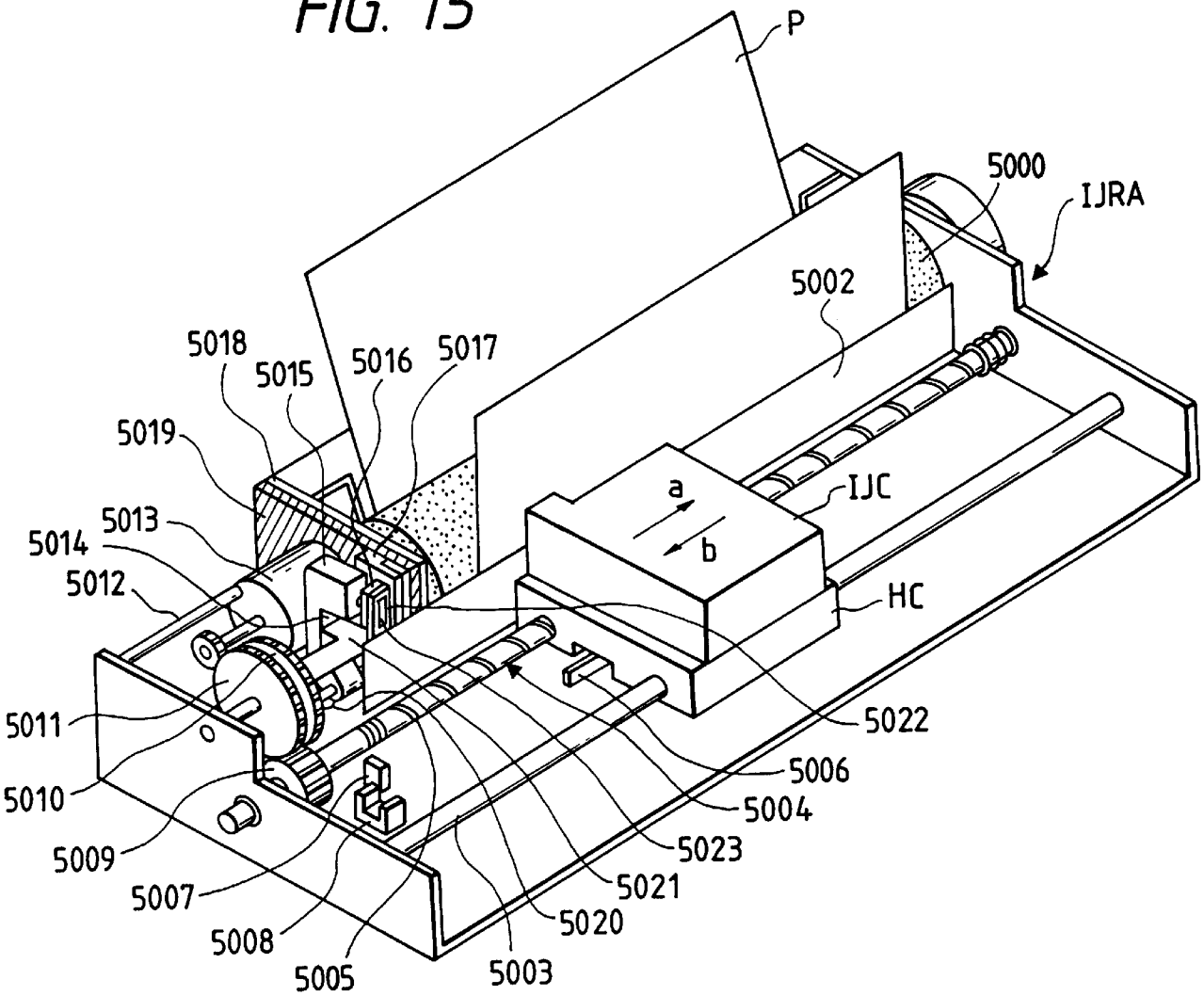
FIG. 15 is a view showing an ink jet recording apparatus employing the ink jet cartridge of the present invention.

FIG. 15 is a perspective view of an ink jet recording apparatus capable of accommodating the ink jet head of the foregoing embodiments.

A capping member 5022, for capping the front face of the recording head, is supported by a member 5016. Suction means 5015, for sucking the interior of the cap, effects suction recovery of the recording head through an aperture 5023 in the cap.

A cleaning blade 5017 and a member 5019 for moving said cleaning blade forward and backward are supported by a support plate 5018 of the main apparatus. The cleaning blade is not limited to the illustrated form, but may naturally have other known configurations.

A lever 5012 is provided for starting the suction recovery operation. When a carriage HC moves to a home position, a part of said carriage HC impinges on a cam 5020, whereby said cam 5020 moves to the left and comes into engagement with a drive transmission gear 5009 to alter the path of the drive transmission.

The operations of capping, cleaning and suction recovery are conducted in respective positions by the function of a lead screw 5005 when the carriage is brought to an area at the home position side, but any configuration capable of executing desired operations at desired timings can be applicable to the present embodiment.

Figure 16:
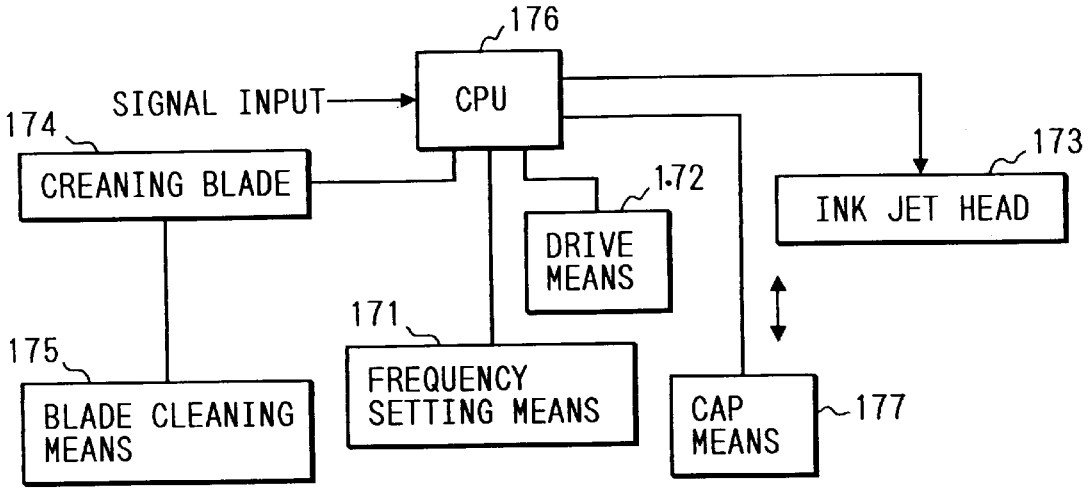
FIG. 16 is a block diagram showing the control system of the ink jet recording apparatus.

Now reference is made to a block diagram shown in FIG. 16, for explaining the control configuration for executing the operations of recording, recovery etc. in the above-explained apparatus. In FIG. 16, a CPU 176 including an interface for receiving the external recording signals, is provided with a program ROM for storing control programs to be executed by said CPU, and a dynamic RAM for storing various data (recording signals mentioned above and recording data to be supplied to the recording head), and also storing the number of printed dots and the number of replacements of the recording head.

Drive means (drive signal supply means) 172 is provided with a gate array for supply control of the recording data to an ink jet head 173 and drives said recording head by the data of the interface, the program ROM and the RAM. Frequency setting means 171 is provided for varying the drive frequency of the drive means 172.

In the present embodiment, the frequency is switched between one for high-speed recording and one for ordinary recording. Cleaning means (cleaning blade) 174 is provided for cleaning the discharge port face of the ink jet head.

Blade cleaning means 175 is provided for removing the ink collected on the blade after cleaning of the ink jet head, thereby cleaning the blade.

Capping means 177 effects a capping operation in case of a trouble in the processing of data under recording, and also in the ordinary suction recovery operation and in the stand-by state.

Figure 17:
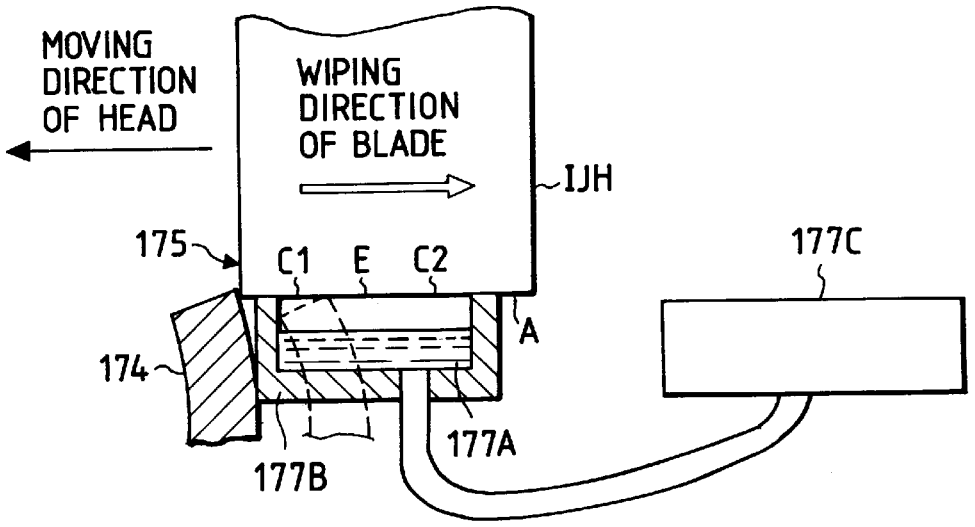
FIG. 17 is a view showing the state of capping and cleaning in the present invention.

FIG. 17 schematically illustrates a state of capping on the ink jet head and a state of cleaning thereof, in combined manner for the purpose of convenience. Consequently the relative positional relationship of the capping means 177 and the blade 174 is not limited to the illustrated one. In the following description, the ink jet head is assumed to be provided with a discharge port face of the surface structure shown in the foregoing embodiments.

The discharge port face of the ink jet head is cleaned by sliding contact of the blade 174 therewith, in the course of movement of said recording head, after the recording operation, toward a predetermined home position along the movement path of said recording head. In this operation, the blade 174 comes at first into contact with a lateral face 175 of the ink jet head.

Subsequently, as the ink jet head moves along the moving path thereof, the blade 174 effects cleaning in the order of the first groove-shaped hydrophilic area 102*a*, the central water-repellent area E and the second groove-shaped hydrophilic area 102*b*.

Such sliding contact of the cleaning face of the blade 174 with the lateral face 175 of the ink jet head at the start of the cleaning operation allows to eliminate the ink deposited on said cleaning face in the preceding cleaning operation.

Consequently the discharge port face can be cleaned with the blade 174 in a clean state, and the cleaning can be achieved in satisfactory state.

The lateral face 175 of the ink jet head where the blade 174 comes into sliding contact may also be provided with an absorbent member of an aluminum plate as a separate member, which can further improve the cleaned state of the blade.

After the discharge port face is cleaned in the above-explained manner, said face is capped by the capping means 177A, whereby said discharge port face of the ink jet head is protected, and the suction recovery of the discharge ports can be achieved by activation of a suction pump 177C connected to said capping means 177A. In the capping means 177A, an absorbent member 177B is provided for absorbing the ink sucked form the discharge ports.

After the cleaning operation (by the suction pump and the blade), the drive means 172 is activated to effect preliminary discharge, thereby expelling the ink which has introduced from the discharge port face into the discharge ports. Also the cleaning operation may be conducted after the ink jet head is released from the capped state but prior to the start of the recording operation. In this manner the ink drops deposited on the discharge port face as a result of the recovery operation can be eliminated satisfactorily, and the satisfactory print state can be maintained from the start of the recording operation.

As explained in the foregoing, the present invention allows to minimize the ink mixing on the discharge port face, by forming, on said discharge port face, a central water-repellent area surrounding an area of plural discharge ports, and hydrophilic areas separated respectively corresponding to the groups of said discharge ports, said hydrophilic areas being provided in at least one of the areas adjacent to said central water-repellent area and spaced from said plural discharge ports by a predetermined distance, along the direction of array thereof.

It is also possible to reduce the leftover in the wiping operation of the blade by forming the hydrophilic area at the starting side of the wiping operation of the blade smaller than the hydrophilic area at the other side of said central water-repellent area.

It is furthermore possible to avoid formation of linkage between the ink in the hydrophilic areas and the ink to be discharged by the ink mist or the left-over ink on the discharge port face after the wiping operation with the blade, by differentiating the distance from the discharge ports to the hydrophilic areas in each group of discharge ports according to the wettability of the used ink on the discharge port face, or more specifically by decreasing said distance for the group of discharge ports utilizing ink with a higher surface tension and a poorer wettability to the discharge port face and increasing said distance for the group of discharge ports utilizing ink of a lower surface tension and a better wettability.

As explained in the foregoing, the present invention is particularly effective in an integral color recording head utilizing plural inks, and can provide an ink jet head capable of satisfactory color recording in continuous manner over a long period and a method for producing such recording head.

What is claimed is:

1. An ink jet head for discharging a plurality of kinds of inks and which is wiped in a predetermined direction by a wiping member, said head comprising:

a discharge port surface provided with a plurality of discharge ports for discharging the inks, said discharge ports being arranged in a plurality of groups for discharging the inks, wherein the groups of said discharge ports each for discharging different kinds of ink are provided in a line, and said discharge port surface has a central water-repellent area provided with said discharge port groups and a plurality of hydrophilic belts are provided adjacent to said central water-repellent area and along an array of said discharge ports, said hydrophilic belts being separately provided for each of said groups of said discharge ports in an arrangement such that said hydrophilic belts and said groups of discharge ports are not overlapped with respect to the predetermined direction.

2. A head according to claim 1, wherein said hydrophilic belt is provided on both of the sides of said array of said discharge ports so that there are two hydrophilic belts, each said hydrophilic belt having a width.

3. A head according to claim 2, wherein said hydrophilic belts have the same width.

4. A head according to claim 2, wherein said discharge port surface is wiped by a cleaning blade and the width of the hydrophilic belt upstream of the wiping by the cleaning blade is narrower than that of the hydrophilic belt downstream of the wiping by the cleaning blade.

5. A head according to claim 4, wherein the width of the hydrophilic belt upstream of the wiping by the cleaning blade is 100–400 $\mu$m and the width of the hydrophilic belt downstream of the wiping by the cleaning blade is 400–800 $\mu$m.

6. A head according to claim 1, wherein said hydrophilic belt is provided on one side of the discharge port array and an island-like hydrophilic area is provided on another side of the discharge port array.

7. A head according to claim 6, wherein said island-like hydrophilic area is provided upstream of the wiping by the cleaning blade as a border of said discharge port array.

8. A head according to claim 1, further comprising:

a plurality of ink paths communicating respectively with each of the discharge ports, a plurality of discharge pressure generating members corresponding respectively to said ink paths, and a liquid chamber communicated with said ink paths corresponding to the discharge ports of each respective group of said groups, said liquid chamber being provided for each said group.

9. A head according to claim 8, wherein said discharge port groups comprise four groups corresponding to yellow, magenta, cyan and black, respectively.

10. A head according to claim 8, wherein said discharge pressure generating members are heat generating members.

11. A head according to claim 1, wherein said plurality of discharge port groups are arranged in a line.

12. A head according to claim 1, wherein said discharge port surface is formed of polysulfone.

13. A head according to claim 1, wherein the length of said hydrophilic belt is longer than that of said discharge port groups corresponding to said hydrophilic belt.

14. A head according to claim 1, wherein sdai hydrophilic belt is provided between said discharge port groups.

15. A head according to claim 1, wherein the provision and the shape of said hydrophilic belt correspondingly vary in accordance with said discharge port groups.

16. A head according to claim 15, wherein an area of said hydrophilic belt corresponding to said discharge port groups which discharge greater ink for one time is larger.

17. A head according to claim 15, wherein the distance between said hydrophilic belt corresponding to said discharge port group having a large diameter and a center of said discharge port is longer.

18. A head according to claim 15, wherein the distance between said hydrophilic belt corresponding to said discharge port group having a high wettability and the periphery of said discharge port is longer.

19. An ink jet head cartridge comprising:

an ink jet head as set forth in any one of claims 1 to 18; and an ink tank for containing ink to be supplied to said ink jet head.

20. An ink jet apparatus comprising:

an ink jet head as set forth in any one of claims 1 to 18; and a drive circuit for driving said ink jet head.

21. An ink jet apparatus comprising:

an ink jet head as set forth in any one of claims 1 to 18; and a blade for wiping said discharge port surface.

22. A method for manufacturing an ink jet head which is wiped in a predetermined direction by a wiping member, said method comprising the steps of:

preparing a discharge port surface containing a plurality of discharge port groups each having a plurality of discharge port arrays provided in a line;

repellent-treating said discharge port surface to form a central water-repellant area provided with said discharge sort groups; and forming a plurality of hydrophilic belts along said discharge port arrays at a location remote from a discharge port forming position and adjacent to said central water-repellant area, said hydrophilic belts being separately provided for each of said groups of discharge ports in an arrangement such that said hydrophilic belts and said groups of discharge ports are not overlapped with respect to the predetermined direction.

23. A method according to claim 22, wherein said hydrophilic belt is formed by laser processing.

24. A method according to claim 22, wherein said discharge port surface is constituted with polysulfone resin.

25. A head according to claim 2, wherein said discharge port surface is wiped by the wiping member and the distance between discharge port and hydrophilic belt upstream of the wiping by the wiping member is longer than the distance between discharge port and the hydrophilic belt downstream of the wiping by the wiping member.

26. An ink jet head for discharging a plurality of kinds of inks and which is wiped in a predetermined direction by a wiping member, said head comprising:

a discharge port surface provided with a plurality of discharge ports for discharging the inks, said discharge ports being arranged in a plurality of groups each for discharging the inks, wherein said discharge port surface has a central water-repellent area provided with said discharge port groups and a plurality of hydrophilic areas provided adjacent to said central water-repellent area and along an array of said discharge ports, said hydrophilic areas being separately provided for each of said groups of said discharge ports in an arrangement, and wherein said discharge port surface is wiped by the wiping member and the distance between the discharge ports and the hydrophilic area upstream of the wiping by the wiping member is longer than the distance between the discharge ports and the hydrophilic area downstream of the wiping by the wiping member.

27. An ink jet head for discharging a plurality of kinds of inks and which is wiped in a predetermined direction by a wiping member, said head comprising:

a discharge port surface provided with a plurality of discharge ports for discharging the inks, said discharge ports being arranged in a plurality of groups for discharging the inks, wherein some of said discharge port groups discharge more ink than others of said discharge port groups, wherein the groups of said discharge ports each for discharging different kinds of ink are provided in a line, and said discharge port surface has a central water-repellent area provided with said discharge port groups and a plurality of hydrophilic areas are provided adjacent to said central water-repellent area and along an array of said discharge ports, said hydrophilic areas being separately provided for each of said groups of said discharge ports in an arrangement, and wherein a given said hydrophilic area corresponding to said discharge port groups which discharge more ink for a given actuation is larger than said hydrophilic area corresponding to other said discharge port groups.

28. An ink jet head for discharging a plurality of kinds of inks and which is wiped in a predetermined direction by a wiping member, said head comprising:

a discharge port surface provided with a plurality of discharge ports for discharging the inks, said discharge ports being arranged in a plurality of groups for discharging the inks, wherein at least some of said discharge port groups discharge a high surface tension ink, wherein the groups of said discharge ports each for discharging different kinds of ink are provided in a line, and said discharge port surface has a central water-repellent area provided with said discharge port groups and a plurality of hydrophilic areas are provided adjacent to said central water-repellent area and along an array of said discharge ports, said hydrophilic areas being separately provided for each of said groups of said discharge ports in an arrangement, and wherein a distance between said hydrophilic area corresponding to said discharge port group which discharges the high surface tension ink and the periphery of said discharge ports is longer than a corresponding distance for others of said discharge port groups.

* * * * *